United States Patent [19]

Tsukamoto et al.

[11] 4,194,465

[45] Mar. 25, 1980

[54] MAGNETIC BRUSH DEVELOPER DEVICE

[75] Inventors: Takuzo Tsukamoto; Tamotsu Sakamoto; Yoshikazu Okamoto, all of Ebina, Japan

[73] Assignee: Fuji Xerox Co., Ltd., Tokyo, Japan

[21] Appl. No.: 846,655

[22] Filed: Oct. 28, 1977

[30] Foreign Application Priority Data

Feb. 24, 1977 [JP] Japan ..... 52-20726[U]

[51] Int. Cl.[2] ..... G03G 13/09

[52] U.S. Cl. ..... 118/658; 430/122

[58] Field of Search ..... 118/653, 655, 656, 657, 118/658, 654, 652; 427/18

[56] References Cited

U.S. PATENT DOCUMENTS

| | | | |
|---|---|---|---|
| 3,367,306 | 2/1968 | Lawes et al. | 118/655 |
| 3,663,291 | 5/1972 | Royka | 118/655 |
| 3,745,905 | 7/1973 | Kobayashi | 355/15 |
| 3,754,526 | 8/1973 | Caudill | 118/658 |
| 3,795,222 | 3/1974 | Jugle et al. | 118/655 |
| 3,863,603 | 2/1975 | Buckley et al. | 118/657 |
| 3,872,828 | 3/1975 | Hartwig et al. | 118/655 |
| 3,977,361 | 8/1976 | Nagashima et al. | 118/658 |
| 4,026,241 | 5/1977 | Takebe et al. | 118/653 |
| 4,033,293 | 7/1977 | Ohmori et al. | 118/656 |

*Primary Examiner*—Mervin Stein

*Attorney, Agent, or Firm*—Sughrue, Rothwell, Mion, Zinn and Macpeak

[57] ABSTRACT

A magnetic brush developing device for a xerographic copying machine is constructed to prevent toner from being leaked out of the developer housing. A magnetic brush roll is provided opposite to a photosensitive member, and at least one air current blade is provided along the lower outer periphery of the surface of the magnetic brush roll. One end of the air current blade is closely adjacent the surface of the photosensitive member, and the other end of the air current blade projects back toward the interior of the developer housing. An air circulating path is defined between the air current blade and the lower outer wall of the developer housing. This air circulating path is effective to conduct entrained air carrying excess toner back into the developer housing.

2 Claims, 3 Drawing Figures

MAGNETIC BRUSH DEVELOPER DEVICE

BACKGROUND OF THE INVENTION

This invention relates to a developing device for a xerographic copying machine, and more particularly to a magnetic brush developing device therefor.

A magnetic brush developing device is used to develop an electrostatic latent image formed on the surface of a photosensitive drum. The magnetic brush is formed by the bristle of a developer composed of electroconductive toner on a magnetic brush roll containing a magnet therein or an insulating toner on an electroconductive carrier.

Since the surface speed of the photosensitive drum is increased and accordingly the rotating speed of the magnetic brush roll is increased as the copying speed of the xerographic copying machine is accelerated, more toner lumps are produced in the developing housing of the developing device. The toner lumps tend to ride on an accelerated entrained air stream adjacent the peripheral surface of the photosensitive drum and are eventually discharged out of the housing in great amounts. This introduces various problems in the machine including a reduction in the performance of various components, a deterioration of the quality of the copying operation due to the contamination of components in the copying machine and also requires an enlargement of the exhaust system of the machine all of which makes maintenance of the machine difficult.

There have been proposed various ways to remove such difficulties of the conventional magnetic brush developing device. For example, it has been proposed that such a magnetic brush developing device be constructed with a large number of slits or air pockets at an opening of the developing housing in the region where an entrained air stream is produced at the peripheral surface of the photosensitive drum to decelerate the flow velocity of the air stream above the peripheral surface of the photosensitive drum thereby causing toner lumps moving with the air stream to drop in the housing. However, the toner lumps cannot be completely prevented from flowing out of the housing by such slits or air pockets. That is, this approach does not have sufficient capability to prevent the toner from being leaked from the device.

FIG. 1 shows another approach in which the conventional magnetic brush developing device operates to carry a developer c onto the surface of a photosensitive drum d. The magnetic force of a magnetic brush roll b provided in a developing housing a forms a bristle e in the developer c, and this bristle e is called a "magnetic brush". An electrostatic latent image on the surface of the drum d is developed by the magnetic brush e. Reference character f represents an agitator. This conventional developing device also has one or a plurality of boundary layer preventive plates g provided as near as possible on the surface of the drum d at an opening h of the housing a, i.e., particularly in the vicinity of an opening h' at the rear end in rotating direction of the drum d of the housing a to thus prevent the toner from flying out of the housing together with the entrained air stream above the surface of the drum d. This structure can considerably reduce the leakage of the toner but still leaks a small amount of toner and therefore is not entirely satisfactory.

The applicants have found that the reason why the toner is still leaked in the device shown in FIG. 1 is that there exists no escape of the air circulating partly in the housing a by the preventive plate g or the end of the housing a above the surface of the drum d so that the pressure of the space i surrounded by the housing a and the preventive plate g and the space j formed by the surface of the drum d, surface of the roll b and the preventive plate g is increased with the result that the air containing the toner is ejected from the gap t between the surface of the drum d and the housing.

SUMMARY OF THE INVENTION

This invention contemplates the elimination of the aforementioned disadvantages, and one object of this invention is to provide a magnetic brush developing device which can completely prevent a toner from being leaked out of a developing housing.

The foregoing and other objects of the invention are attained by providing at least one air current blade along the lower outer periphery of the surface of the magnetic brush roll. One end of the air current blade is adjacent to the surface of the photosensitive drum. The effect of the air current blade is to form an air circulating path between the blade and the outer wall of the developer housing. This air circulating path communicates with the interior space of the housing thereby preventing an increase in pressure in the vicinity of the exit opening of the developer housing. As a result, excess toner is recirculated into the developer housing.

BRIEF DESCRIPTION OF THE DRAWINGS

The specific features of the invention will be better understood from the following detailed description with reference to the drawings, in which.

DETAILED DESCRIPTION OF THE PREFERRED EMBODIMENT

One preferred embodiment of this invention will be particularly described with reference to FIGS. 2 and 3.

Figure 1:
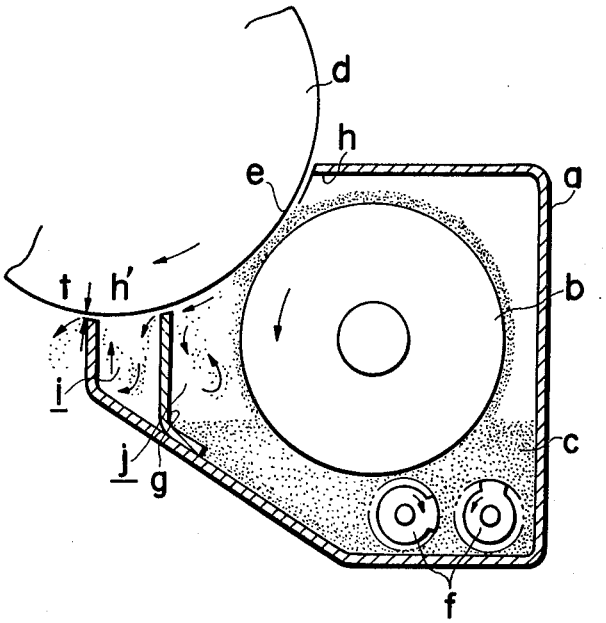
FIG. 1 PRIOR ART
FIG. 1 is a cross-sectional view illustrating the structure of a conventional magnetic brush developing device.
Figure 2:
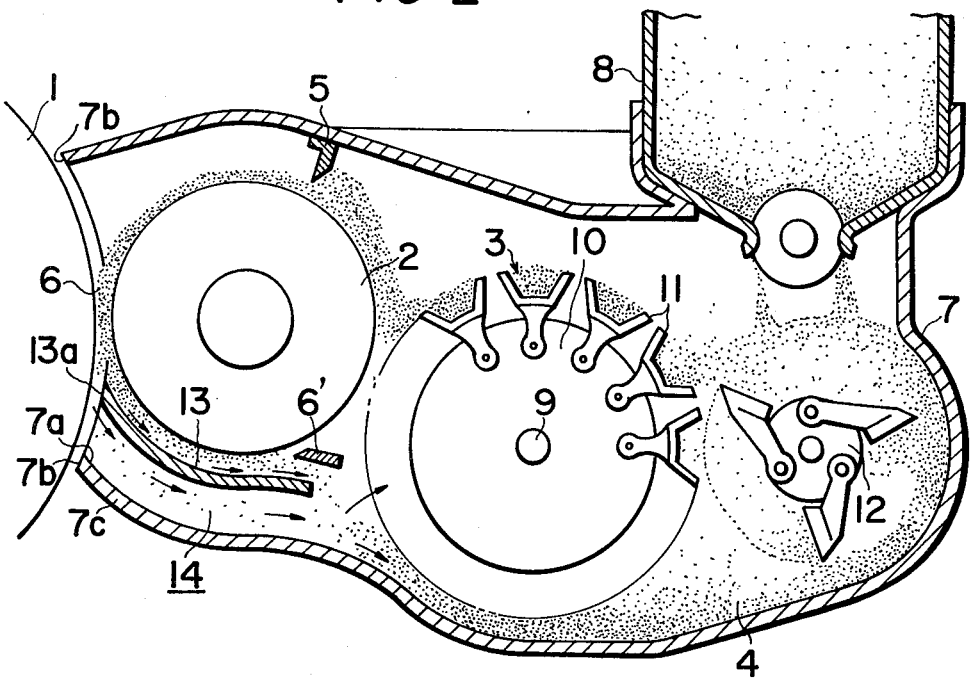
FIG. 2 is a cross-sectional view showing the structure of one preferred embodiment of the invention.
Figure 3:
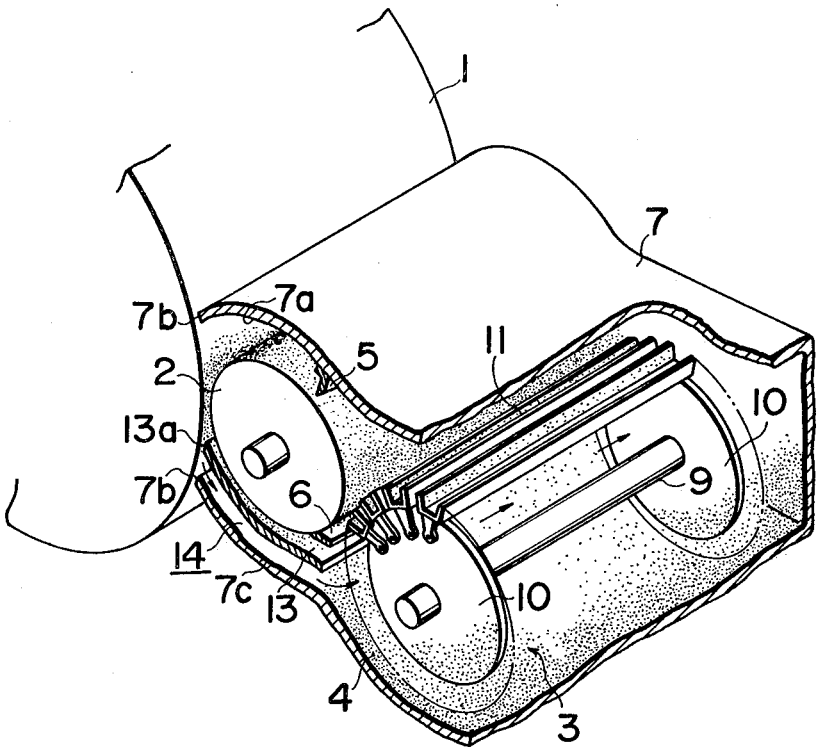
FIG. 3 is a fragmentary perspective view further illustrating the structure and operation of the invention.

FIG. 2 is a sectional view of a magnetic brush developing device constructed according to this invention. This device has a photosensitive drum 1 and a magnetic brush roll 2 provided opposite to the drum 1 which roll 2 serves to attract by magnetic force a developer 4 composed of iron powder carrier and thermoplastic toner powder. The developer 4 is supplied from a developer carrying bucket 3, the amount of developer on the roll 2 is adjusted by a control plate 5. A bristle 6 is formed in the developer 4 to thus develop an electrostatic latent image on the surface of the drum 1. The developer 4 is, upon completion of development, separated from the surface of the roll 2 by a scraping plate 6' and then returned to the bottom of the housing 7. The toner consumed by the development is replenished by a toner supply unit 8. The developer carrying bucket 3 is composed of a large number of U-shaped buckets 11 mounted around two discs 10, 10 spaced within the housing 7 on a rotary shaft 9. As may be seen in FIG. 3, there is sufficient space between the discs 10, 10 and among the buckets 11 to permit free air flow. An agitator 12 under the toner supply unit 8 agitates the carrier and the toner.

At the lower portion of an opening 7*a* of the housing 7 is provided an air current blade 13 adjacent at one end thereof to the drum 1 and extending to the vicinity of the developer carrying bucket 3 along the outer periphery of the roll 2. The air current blade serves the purpose of conducting the air stream above the surface of the roll 2 toward the bucket 3 and also collecting the boundary layer of air entrained by the drum 1 and circulate the air stream into the bucket 3. The housing 7 has an open end 7*b* adjacent to the drum 1, and this open end is spaced so as to have a relatively large gap from the blade 13. Thus, the entrained air produced above the surface of the drum 1 is also collected at the end 7*b* of the housing 7 adjacent to the drum 1 similarly to the action of the blade 13. A circulating air path 14 is formed by the outer wall 7*c* of the housing 7 and the blade 13 toward the bucket 3. Thus, the boundary layer of entrained air formed mostly above the peripheral surface of the drum 1 is circulated in the housing 7. The end 13*a* of the blade 13 is located as nearly adjacent as possible to the surface of the drum 1 to thereby prevent entrained air at the end 7*b* from forming a boundary layer extending to the surface of the drum 1. Since the developer carrying bucket 3 has large gaps as described above, all the air flow between the roll 2 and the blade 13 and between the blade 13 and the outer wall 7*c* of the housing 7 can escape into the broad housing 7 to cause the air pressure in the vicinity of the opening of the housing 7 not to become increased and accordingly the toner not to be ejected out of the housing 7.

In the magnetic brush developing device thus constructed, a great deal of toner is adhered to the opposite wall surfaces of the blade 13 and outer wall 7*c* of the housing 7 so that if the operation is continued without removing the adhered toner, much toner may eventually be ejected from the opening end 7*b* of the housing 7. Therefore, the magnetic brush developing device of this invention is constructed to prevent such ejection of the toner by insulating the opposite wall surfaces of the blade 13 and the outer wall 7*c* of the housing 7. Since the toner particles are adhered onto the wall surfaces, the opposite wall surfaces gradually become charged and have the same polarity as that of the electric charges of the toner. Accordingly, when the amount of toner adhered onto the wall surfaces reaches a predetermined value, toner passing between the opposite walls thereafter is repelled from both the wall surfaces without being adhered thereto but is instead recirculated into the interior of the housing 7.

Where necessary, a greater effect can be provided with the addition of more current blades 13. In any case, it should be understood from the foregoing description that local pressure increase in the vicinity of the opening end 7*b* of the housing 7 is eliminated by this invention to thus smoothly circulate the air stream therein so as to prevent the toner from being leaked from the opening end 7*b* of the housing and, accordingly, the components in the device from being contaminated.

What is claimed is:

1. In a xerographic copying machine of the type having a rotatable photosensitive member, a developer housing positioned closely adjacent to the periphery of said rotatable photosensitive member, and a magnetic brush roll located within said developer housing opposite said rotatable photosensitive member, the improvement comprising:

at least one air current blade provided along the lower outer periphery of the surface of said magnetic brush roll and positioned to be adjacent at one end thereof to said rotatable photosensitive member and extending back into the interior of said developer housing to conduct the air stream above the surface of said magnetic brush roll toward the interior of said developer housing and to collect the boundary layer of air entrained by the rotation of said rotatable photosensitive member, said developer housing having an opening adjacent said rotatable photosensitive member and spaced from said air current blade so that an air circulating path is defined by the outer wall of said developer housing and said air current blade whereby entrained air carrying excess toner is recirculated back into said developer housing; and a developer carrying bucket located within said developer housing for supplying developer to said magnetic brush roll, said developer carrying bucket being composed of a plurality of U-shaped buckets mounted around two discs spaced within said developer housing on a rotary shaft, sufficient space between said two discs and among said plurality of U-shaped buckets being provided to permit free air flow, said air current blade extending to the vicinity of said developer carrying bucket.

2. In a xerographic copying machine of the type having a rotatable photosensitive member, a developer housing positioned closely adjacent to the periphery of said rotatable photosensitive member, and a magnetic brush roll located within said developer housing opposite said rotatable photosensitive member, the improvement comprising:

at least one air current blade provided along the lower outer periphery of the surface of said magnetic brush roll and positioned to be adjacent at one end thereof to said rotatable photosensitive member and extending back into the interior of said developer housing to conduct the air stream above the surface of said magnetic brush roll toward the interior of said developer housing and to collect the boundary layer of air entrained by the rotation of said rotatable photosensitive member, said developer housing having an opening adjacent said rotatable photosensitive member and spaced from said air current blade so that an air circulating path is defined by the outer wall of said developer housing and said air current blade whereby entrained air carrying excess toner is recirculated back into said developer housing, and said at least one air current blade and said outer wall of the developer housing are electrically insulated so that each will become electrically charged as toner particles adhere thereto, thereby repelling said toner particles and inhibiting the further accumulation of toner particles on said at least one air current blade and outer wall of said developer housing.

* * * * *